US010086305B2

(12) United States Patent
Juliano et al.

(10) Patent No.: US 10,086,305 B2
(45) Date of Patent: Oct. 2, 2018

(54) TOY VEHICLE TRACK RISER

(71) Applicant: Mattel, Inc., El Segundo, CA (US)

(72) Inventors: Corey Lynn Juliano, New York, NY (US); Thomas Louis DiFazio, Jr., Brooklyn, NY (US)

(73) Assignee: Mattel, Inc., El Segundo, CA (US)

( * ) Notice: Subject to any disclaimer, the term of this patent is extended or adjusted under 35 U.S.C. 154(b) by 265 days.

(21) Appl. No.: 15/001,288

(22) Filed: Jan. 20, 2016

(65) Prior Publication Data

US 2016/0236109 A1 Aug. 18, 2016

Related U.S. Application Data

(60) Provisional application No. 62/105,319, filed on Jan. 20, 2015.

(51) Int. Cl.

| | |
|---|---|
| ***A63H 18/02*** | (2006.01) |
| ***A63H 18/04*** | (2006.01) |
| ***A63H 19/30*** | (2006.01) |

(52) U.S. Cl.

CPC ..... *A63H 18/02* (2013.01); *A63H 18/04* (2013.01); *A63H 19/30* (2013.01)

(58) Field of Classification Search

CPC ..... A63H 18/02; A63H 19/30; A63H 19/34; A63H 18/04

See application file for complete search history.

(56) References Cited

U.S. PATENT DOCUMENTS

| | | | | |
|---|---|---|---|---|
| 1,828,536 | A * | 10/1931 | Koerber | A63H 19/30 104/56 |
| 2,161,276 | A | 6/1939 | Bonnett | |
| 2,852,198 | A | 9/1958 | Kramer | |
| 3,225,487 | A | 12/1965 | Mallalieu | |
| 3,712,539 | A | 1/1973 | Staats | |
| 3,712,540 | A | 1/1973 | Yamasaki et al. | |
| 4,403,733 | A * | 9/1983 | Bach | A63H 19/30 238/10 E |
| 4,826,076 | A | 5/1989 | Hesse | |
| 4,951,872 | A | 8/1990 | Sheffield | |
| 5,456,410 | A | 10/1995 | Chow | |
| 5,779,145 | A | 7/1998 | Zelle et al. | |
| 5,979,783 | A | 11/1999 | Toht et al. | |
| 7,354,006 | B1 | 4/2008 | Bricker | |
| 7,959,087 | B2 | 6/2011 | Tarr | |

(Continued)

FOREIGN PATENT DOCUMENTS

| | | |
|---|---|---|
| GB | 2035105 B | 6/1980 |
| GB | 2247184 B | 2/1992 |

*Primary Examiner* — Zachary L Kuhfuss

(74) *Attorney, Agent, or Firm* — Edell, Shapiro & Finnan, LLC

(57) ABSTRACT

The present invention relates to a track riser for a toy vehicle track set. The track riser includes a pair of track depressions and a male and female connector that enable other track sections to be coupled to the track riser so that a toy vehicle can travel along the track sections and over the track riser. The track riser also includes a pair of openings. The male connectors of two equally sized track sections can be inserted through the openings of the track riser so that the track sections extend downwardly from the track riser. In this orientation, the two track sections act as supports to raise the track riser above the support surface.

16 Claims, 12 Drawing Sheets

(56) References Cited

U.S. PATENT DOCUMENTS

| | | | | |
|---|---|---|---|---|
| 9,061,218 | B2 * | 6/2015 | DiBartolo | A63H 19/30 |
| 2010/0248586 | A1 * | 9/2010 | Cochella | A63H 18/02<br>446/444 |
| 2013/0126628 | A1 * | 5/2013 | DiBartolo | A63H 19/30<br>238/10 A |
| 2014/0084074 | A1 | 3/2014 | O'Connor et al. | |
| 2014/0206256 | A1 | 7/2014 | Chan et al. | |
| 2015/0283472 | A1 * | 10/2015 | Chantrell | A63H 19/36<br>238/10 F |

* cited by examiner

TOY VEHICLE TRACK RISER

CROSS REFERENCE TO RELATED APPLICATIONS

This application claims priority to and the benefit of U.S. Provisional Patent Application No. 62/105,319, filed Jan. 20, 2015, entitled "Toy Vehicle Track Riser," the contents of which are hereby incorporated by reference in their entirety.

FIELD OF THE INVENTION

The present invention relates to toy tracks, and more specifically toy track sections that are capable of interlocking with one another. The present invention further relates to a track riser that is coupled to multiple toy track sections that enable the track riser to create an elevated track section.

BACKGROUND OF THE INVENTION

Various types of toy tracks are known. Many of the toy track sections are configured to interlock with each other to expand the layout of the toy track, which enable larger and more diverse play patterns. Various different types of toy track sections are known, including flat tracks, curved tracks, ascending tracks, merging tracks, etc. It is know that various structures can also be incorporated with the various toy tracks to further diversify the play patterns with the toy tracks. One way of adding additional play value to toy tracks is to create portions of track that are at varying heights. With current toy tracks, in order to create sections of the toy tracks at varying heights, bulky structures often need to be incorporated into the track. Because of the size of the structures, a large amount of track sections may be needed to create portions of the track a various heights. Furthermore, these structures are often expensive. Other ways of creating portions of track at various heights include multiple supports that are positioned beneath the track sections. These supports, however, are often not sturdy because they simply cradle elevated track section from below. Also, the supports are limited to creating just one height.

Thus, there is a need for a track riser that can be incorporated with track sections to enable and support elevated track sections. Moreover, there is a need for a stable and sturdy track riser that interlocks with the track sections to further add stability to the portion of the track that is elevated. There is also a need to a track riser that can be used at multiple different heights to enable portions of track at various different heights. Finally, there is a need for a track riser that is inexpensive and easy to incorporate with the existing toy tracks.

SUMMARY OF THE INVENTION

In one embodiment, a portion of a toy track or a track riser includes a body, a first connector, and a second connector. The body includes a top surface, a bottom surface, a first side, a second side, a front end, and a rear end. The top surface of the track riser includes a pair of track depressions that run parallel to one another from the front end to the rear end of the track riser. The first connector extends from the front end of the track riser, while the second connector is disposed in the rear end of the track riser. The first connector may be a male connector, while the second connector may be a female connector. The first and second connectors enable other track sections to be removably coupled to the track riser. The track riser further includes a first opening and a second opening. The first opening extends from the top surface through the body to the bottom surface of the track riser, where the first opening is disposed proximate to the first side of the body. Similarly, the second opening extends from the top surface through the body to the bottom surface of the track riser, where the second opening is disposed proximate to the second side of the body. The first and second openings are sized and shaped to receive the male connector portions of other track sections. The male connectors of the other track sections may be inserted through the openings of the track riser through the bottom surface of the track riser. The inserted track sections then extend downwardly from the track riser, where the track sections serve as supports to support the track riser above the support surface.

BRIEF DESCRIPTION OF THE DRAWINGS

Like reference numerals have been used to identify like elements throughout this disclosure.

DETAILED DESCRIPTION OF THE INVENTION

Figure 1:
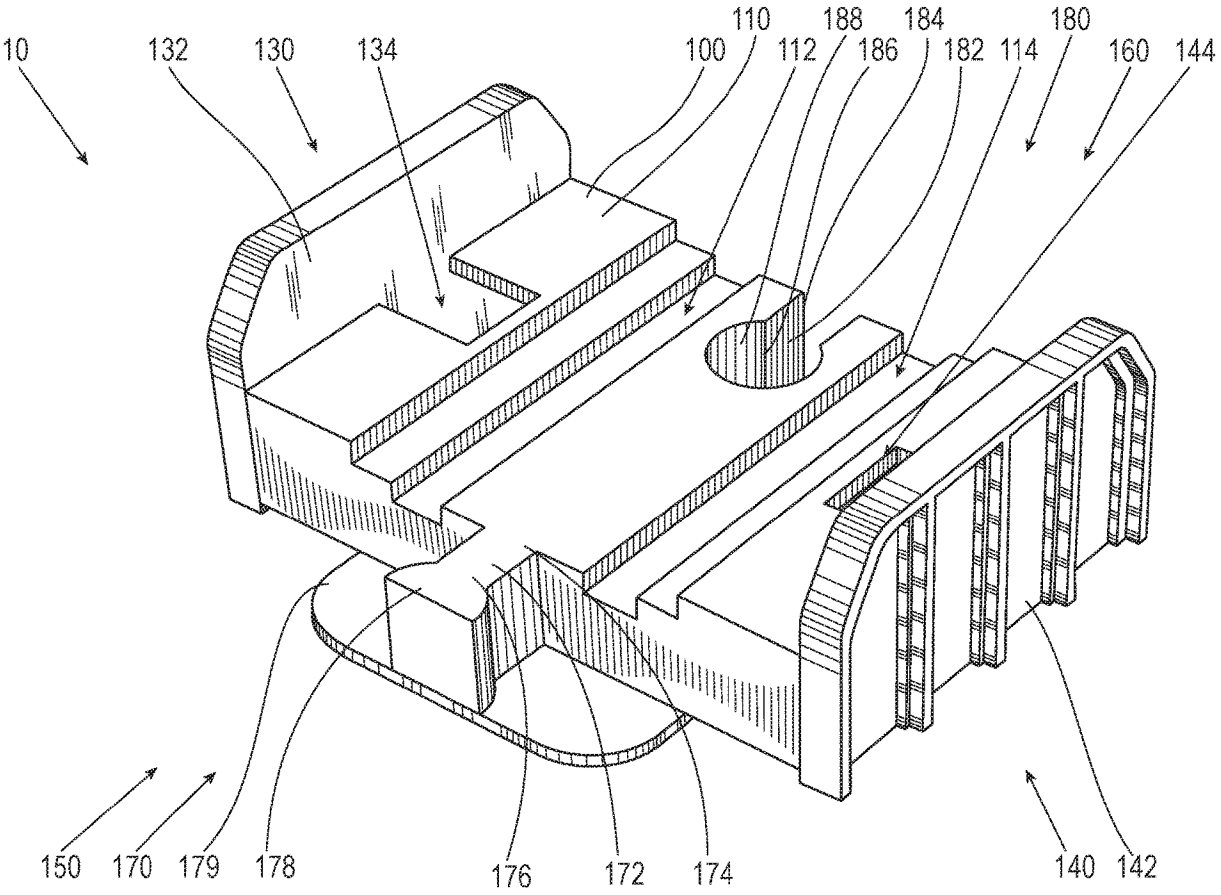
FIG. 1 illustrates a perspective view of a first embodiment of the track riser in accordance with the present invention.

Illustrated in FIGS. 1-6 is a first embodiment of a track riser 10. As illustrated, the track riser 10 includes a body 100, a male connector 170 and a female connector 180. The body 100 of the track riser 10 includes a top surface 110, a bottom surface 120, a first side 130, a second side 140, a front end 150, and a rear end 160. As illustrated, the track riser 10 is substantially rectangular in shape. Other embodiments of the track riser 10 may be in another shape, such as an arc or a circle. As best illustrated in FIGS. 1, 3, 4, and 5, the top 110 of the track riser 10 includes a first track depression 112 and a second track depression 114. The first track depression 112 and the second track depression 114 are substantially linear and run across the top surface 110 of the track riser 10 from the front end 150 to the rear end 160. The first track depression 112 is positioned on the top surface 110 of the track riser 10 at a location closer to the first side 130 of the track riser 10 than to the second side 140 of the track riser 10. Conversely, the second track depression 114 is positioned on the top surface 110 of the track riser 10 at a location closer to the second side 140 of the track riser 10 than to the first side 130 of the track riser 10. Moreover, the first and second track depressions 112, 114 are spaced apart from one another a distance A (see FIG. 3), and the track depressions 112, 114 are configured to receive the wheels of a toy vehicle (not shown).

Figure 2:
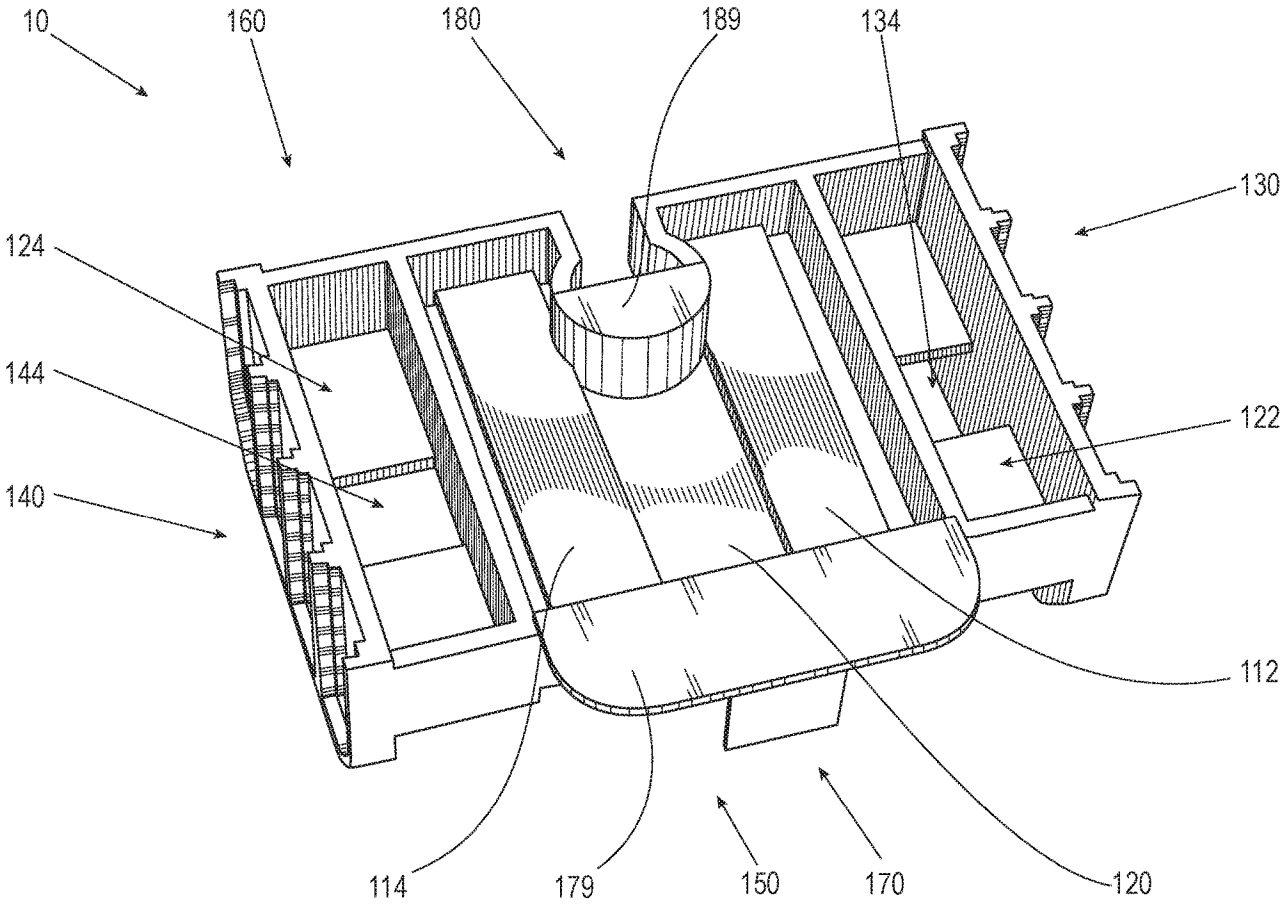
FIG. 2 illustrates bottom view of the track riser illustrated in FIG. 1.
Figure 5:
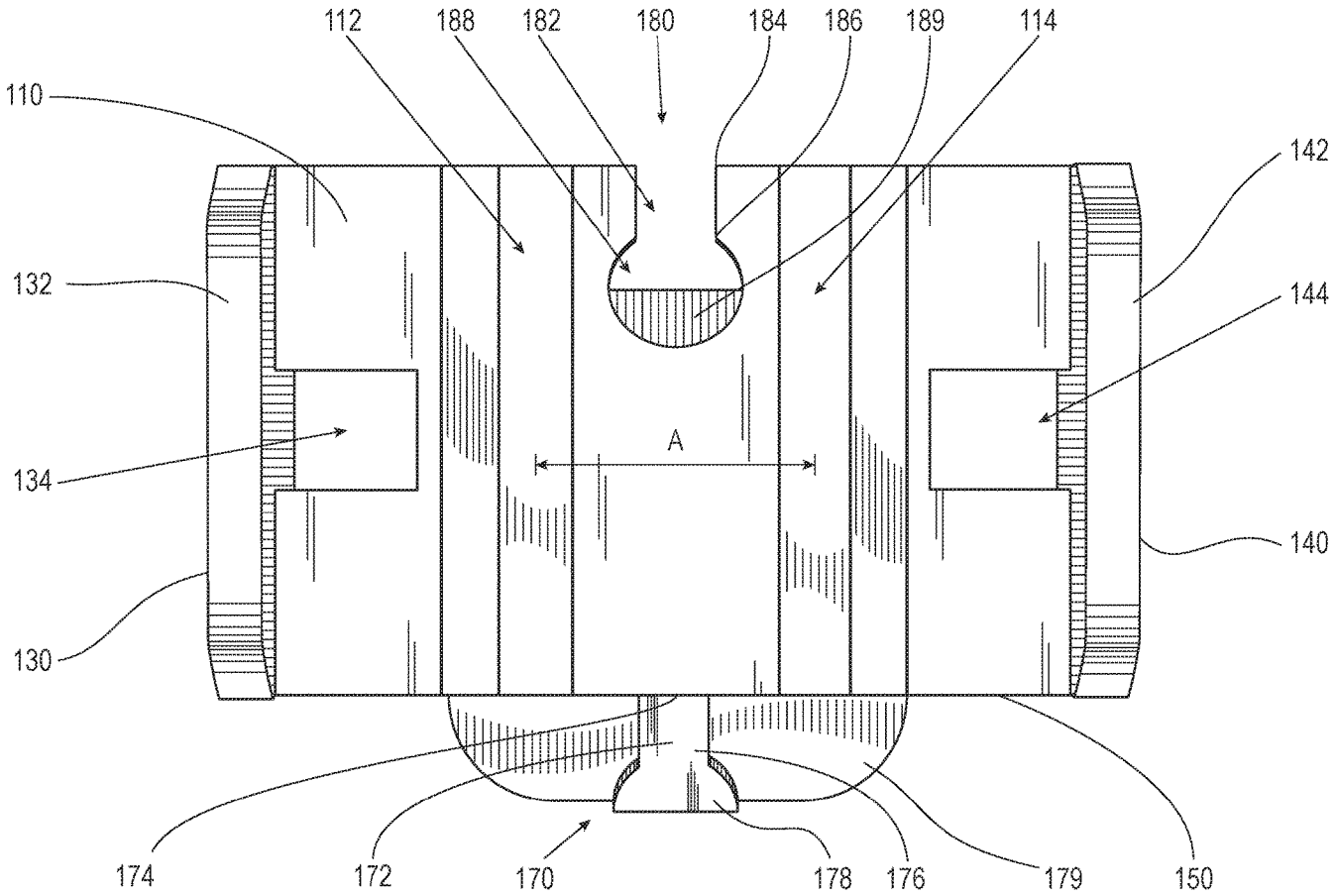
FIG. 5 illustrates a top view of the track riser illustrated in FIG. 1.

As best illustrated in FIGS. 1, 2, and 5, the track riser 10 includes a first opening 134 and a second opening 144. The first and second openings 134, 144 extend through the body 100 of the track riser 10 between the top surface 110 and the bottom surface 120 of the track riser 10. Best illustrated in FIG. 5, the first opening 134 is positioned proximate to the first side 130 of the track riser 10, while the second opening 144 is positioned proximate to the second side 140 of the track riser 10. Furthermore, the first and second openings 134, 144 are positioned on the body 100 equidistant from the front end 150 and the rear end 160. As illustrated in FIG. 2, the bottom 120 of the track riser 120 includes a first slot 122 and a second slot 124. The first and second slots 122, 124 extend the length of the track riser 10 from the front end 150 to the rear end 160. The first slot 122 is disposed proximate to the first side 130 of the track riser 10, and surrounds the first opening 134. In other words, the first opening 134 is disposed within the first slot 122. The second slot 124 is disposed proximate to the second side 140 of the track riser 10, and surrounds the second opening 144. Similar to that of the first slot 122, the second opening 144 is disposed within the second slot 124. In another embodiment of the track riser 10, the track riser 10 may include a first receiver and a second receiver that are coupled to the bottom surface 120 of the track riser 10. In this embodiment, the first receiver is positioned in substantially the same location as the first opening 134, while the second receiver is positioned in substantially the same location as the second opening 144. However, the first and second receivers differ from the first and second openings 134, 144 in that the first and second receivers do not extend between the top surface 110 and the bottom surface 120. The first and second receivers may only extend inwardly from the bottom surface 120. Thus, the first and second receivers are not visible when viewing the top of the track riser 10.

Figure 3:
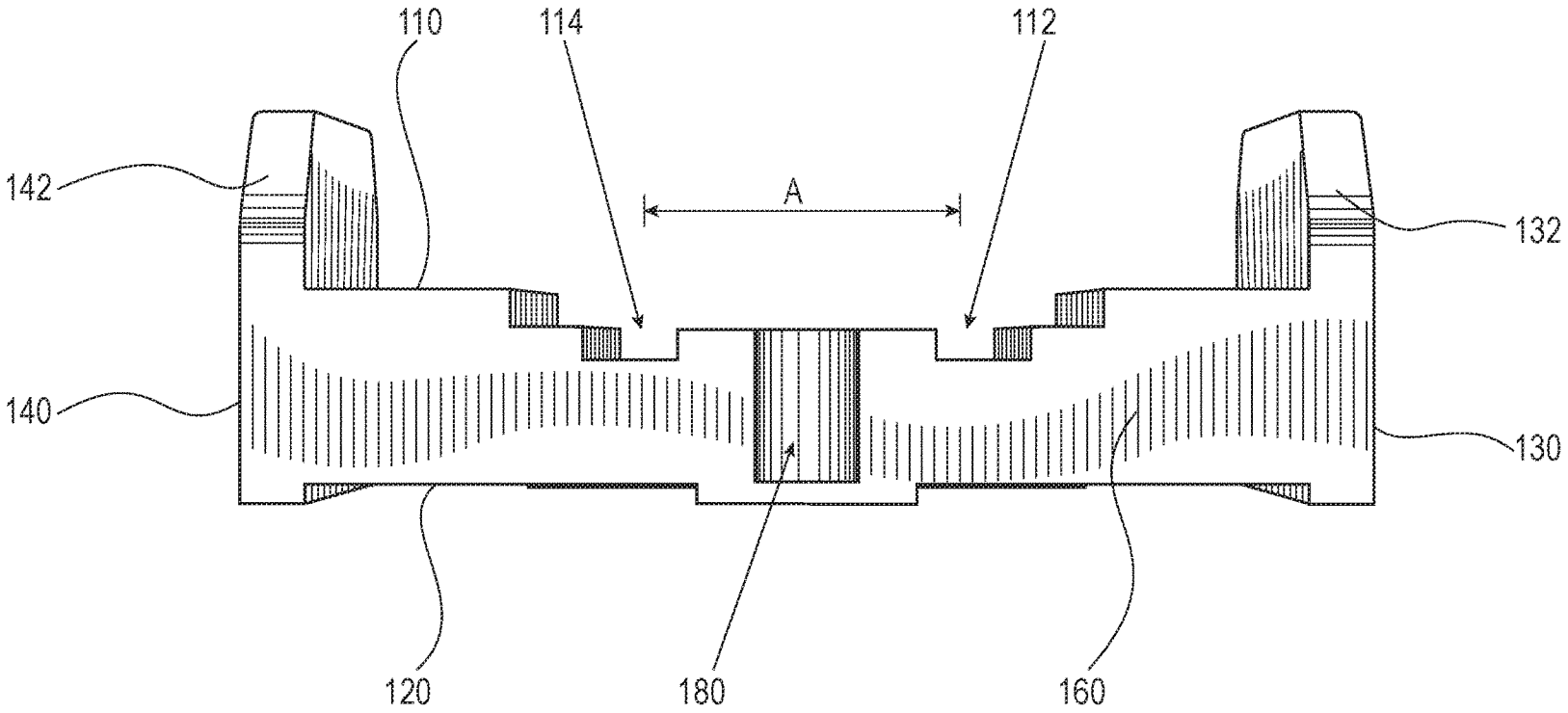
FIG. 3 illustrates a rear view of the track riser illustrated in FIG. 1.
Figure 4:
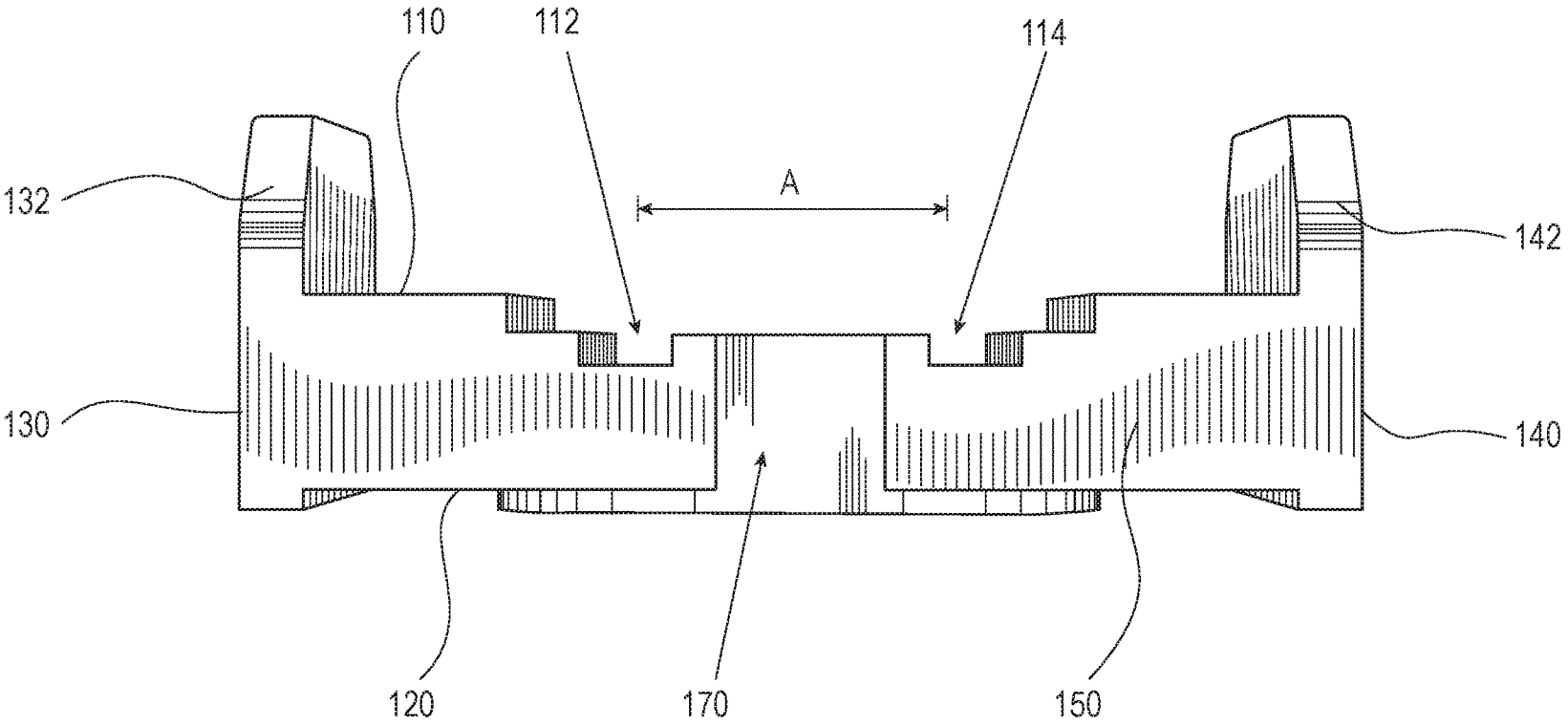
FIG. 4 illustrates a front view of the track riser illustrated in FIG. 1.
Figure 6:
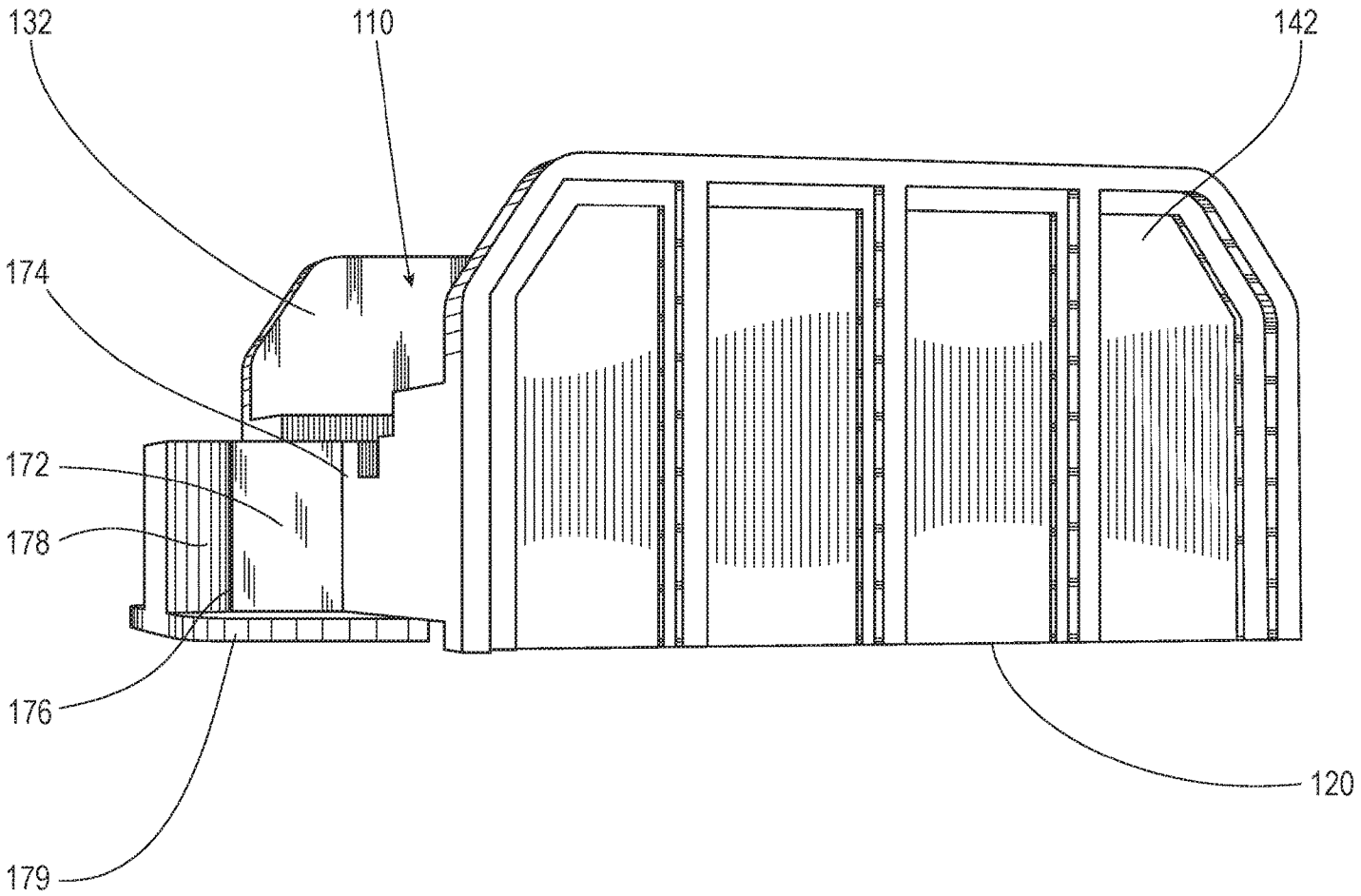
FIG. 6 illustrates a side view of the track riser illustrated in FIG. 1.

FIGS. 1 and 3-6 best illustrate the guard rails 132, 142 of the track riser 10. As illustrated, the first side 130 of the track riser 10 includes a first guard rail 132 and the second side 140 of the track riser 10 includes a second guard rail 142. The first and second guard rails 132, 142 extend upwardly from the first and second sides 130, 140 and above the top surface 110 of the track riser 10. FIGS. 3, 4, and 6 best illustrate the guard rails 132, 142 extending upwardly from the first and second side 130, 140 beyond the top surface 110 of the track surface 10.

As best illustrated in FIGS. 1, 5, and 6, the male connector 170 of the track riser 10 extends from the front end 150 of the track riser 10. The male connector 170 includes an extension portion 172, a protrusion portion 178, and a platform 179. The extension portion 172 includes a first end 174 and a second end 176. The first end 174 of the extension portion 172 is coupled to the front end 150 of the track riser 10. The extension portion 172 extends away from the front end 150 of the track riser 10 with the protrusion portion 178 being coupled to the second end 176 of the extension portion 172. As illustrated, the protrusion portion 178 is wider than the extension portion 172. The protrusion portion 178 may also include rounded edges. As best illustrated in FIGS. 1 and 5, the protrusion portion 178 is in the shape of a half cylinder. In other embodiments, the protrusion portion 178 may be in the shape of a full cylinder. Moreover, a platform 179 extends from the front end 150 of the track riser 10 proximate to the bottom 120 of the track riser 10, as best illustrated in FIG. 2. The platform 179 is positioned beneath the extension portion 172 and the protrusion portion 178.

FIGS. 1, 5, and 6, also best illustrated the female connector 180 of the track riser 10, which is disposed proximate to the rear end 160 of the track riser 10. The female connector 180 includes a first cavity portion 182 and a second cavity portion 188. The first cavity portion 182 includes a first end 184 and a second end 186. The first end 184 of the first cavity portion 182 is disposed proximate to the rear end 160 of the track riser 10. The first cavity portion 182 extends into the body 100 of the track riser from the rear end 160 of the track riser 10, forming a cavity in the body 100 of the track riser 10. Disposed on the second end 186 of the first cavity portion 182 is the second cavity portion 188, which is also formed in the body 100 of the track riser 10. As illustrated, the second cavity portion 188 is wider than the first cavity portion 182. The second cavity portion 188 is cylindrical in shape. FIG. 5, which illustrates the top view of the track riser, shows that the second cavity portion 188 has a circular cross section. Furthermore, as best illustrated in FIGS. 2 and 5, a platform 189 is positioned underneath a portion of the second cavity portion 188. FIG. 2 illustrates that the platform 189 is disposed on the bottom 120 of the track riser 10 and is in line with the bottom of the second cavity portion 188.

Figure 7:
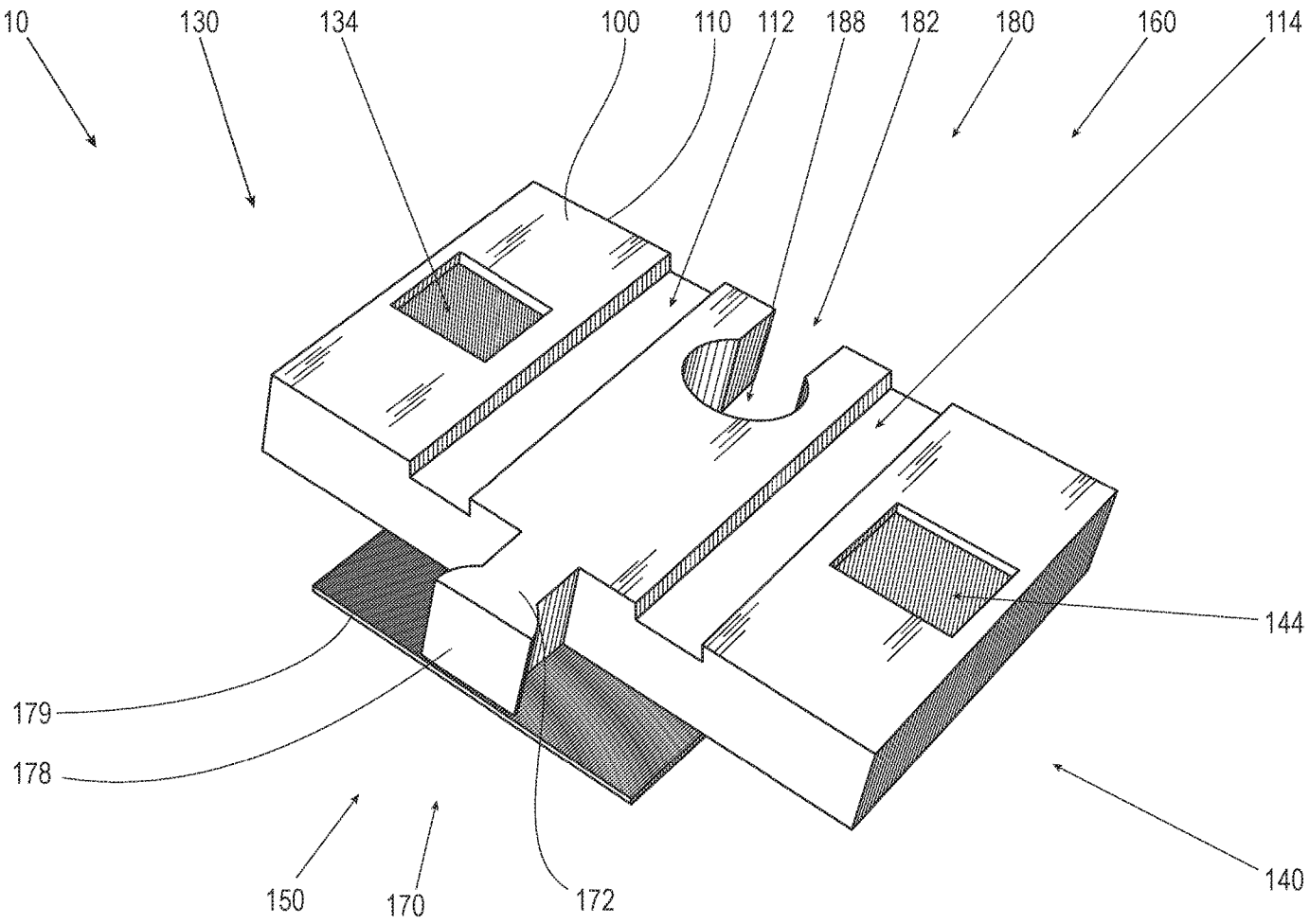
FIG. 7 illustrates a perspective view of a second embodiment of the track riser in accordance with the present invention.

Turning to FIG. 7, illustrated is a second embodiment of a track riser 10 in accordance with the present invention. The second embodiment of the track riser 10 is substantially similar to the first embodiment of the track riser 10. As illustrated in FIG. 7, the second embodiment of the track riser 10 includes a body 100, a male connector 170, and a female connector 180. The body 100 includes a top surface 110, a bottom surface 120, a first side 130, a second side 140, a front end 150 and a rear end 160. Similarly to the first embodiment of the track riser 10, the second embodiment of the track riser 10 includes first and second track depressions 112, 114 disposed on the top surface 110 of the track riser 10, as well as first and second openings 134, 144 that extend between the top surface 110 and the bottom surface 120. The second embodiment of the track riser 10, however, differs from the first embodiment of the track riser 10 in that the second embodiment of the track riser 10 does not include first and second guard rails 132, 142.

Figure 8:
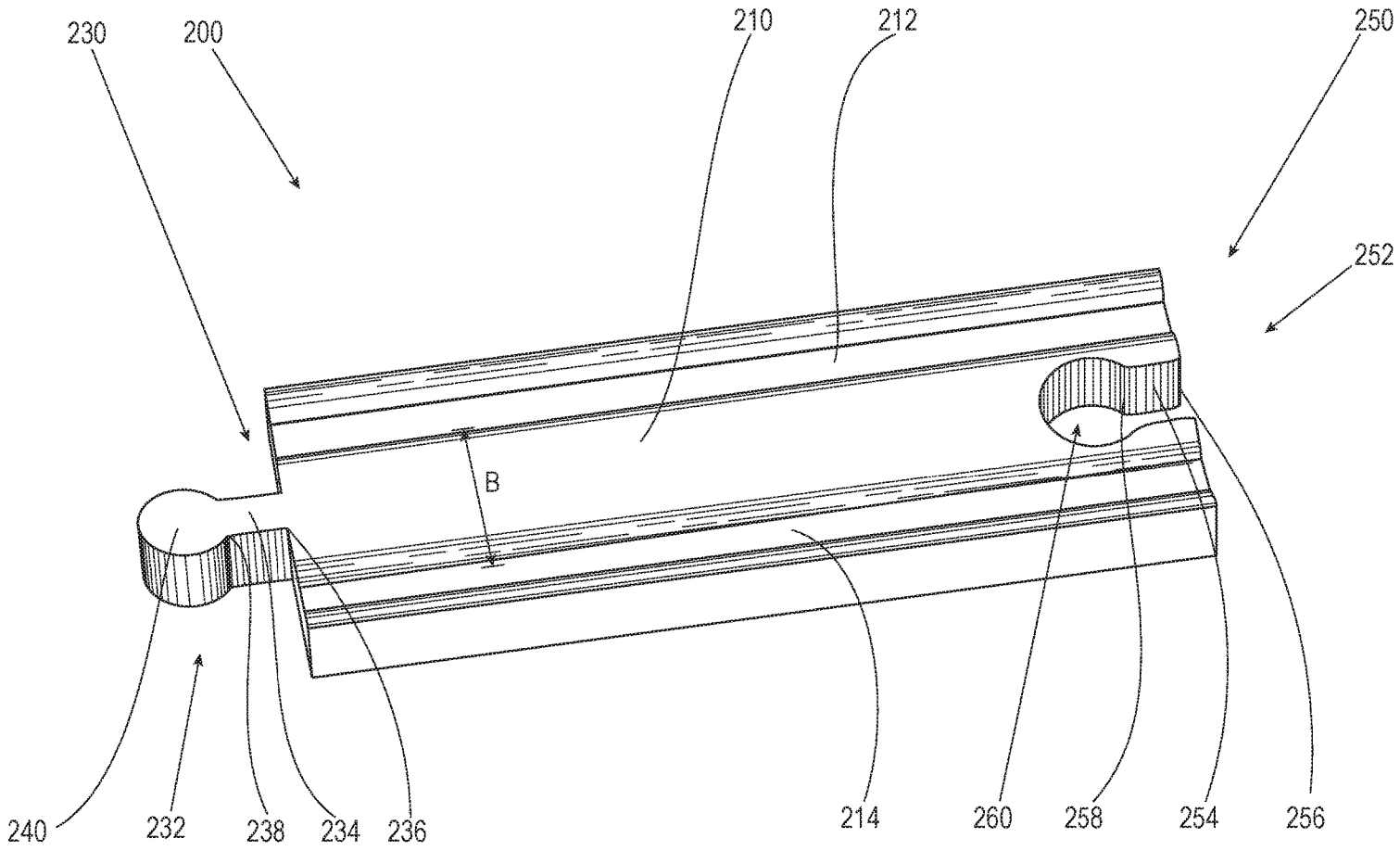
FIG. 8 illustrates a perspective view of a flat track section configured to be coupled to the track risers illustrated in FIGS. 1 and 7.

Turning to FIG. 8, illustrated is a flat track section 200 that is configured to be coupled to the track riser 10 or another track section 200, 300. The flat track section 200 includes a top surface 210, a bottom surface 220 (illustrated in FIG. 10), a first end 230, and a second end 250. As illustrated in FIG. 8, the flat track section 200 is substantially flat. Moreover, the top surface 210 includes a first track depression 212 and a second track depression 214. The first and second track depressions 212, 214 of the flat track section 200 are spaced from one another a distance B. The distance B is equivalent to the distance A, which is the length of the spacing between the first and second track depressions 112, 114 of the track riser 10. The first and second track depressions 212, 214 are disposed on the flat track section 200 to extend from the first end 230 to the second end 250 of the flat track section 200.

The flat track section 200 includes a male connector 232, substantially similar to the male connector 170 of the track riser 10, and a female connector 252, substantially similar to the female connector 180 of the track riser 10. As illustrated in FIG. 8, the male connector 232 of the flat track section 200 extends from the first end 230 of the flat track section 200. This male connector 232 also includes an extension portion 234 and a protrusion portion 240. The extension portion 234 includes a first end 236 and a second end 238, where the first end 236 of the extension portion 234 is coupled to the first end 230 of the flat track section 200. Moreover, the protrusion portion 240 is coupled to the second end 238 of the extension portion 234. As illustrated in FIG. 8, the protrusion portion 240 is substantially cylindrical in shape, and is wider than the extension portion 234 of the male connector 232.

The female connector 252 of the flat track section 200 includes a first opening portion 254 and a second opening portion 260. The first opening portion 254 includes a first end 256 and a second end 258, where the first end 256 is disposed proximate to the second end 250 of the flat track section 200. The first opening portion 254 extends inwardly from the second end 250 of the flat track section 200 toward the first end 230 of the flat track section 200, creating an opening that extends between the top surface 210 and the bottom surface 220 of the flat track section 200. Disposed on the second end 258 of the first opening portion 254 is the second opening portion 260. As illustrated, the second opening portion 260 has a substantially circular cross section and extends between the top surface 210 and the bottom surface 220.

Figure 9:
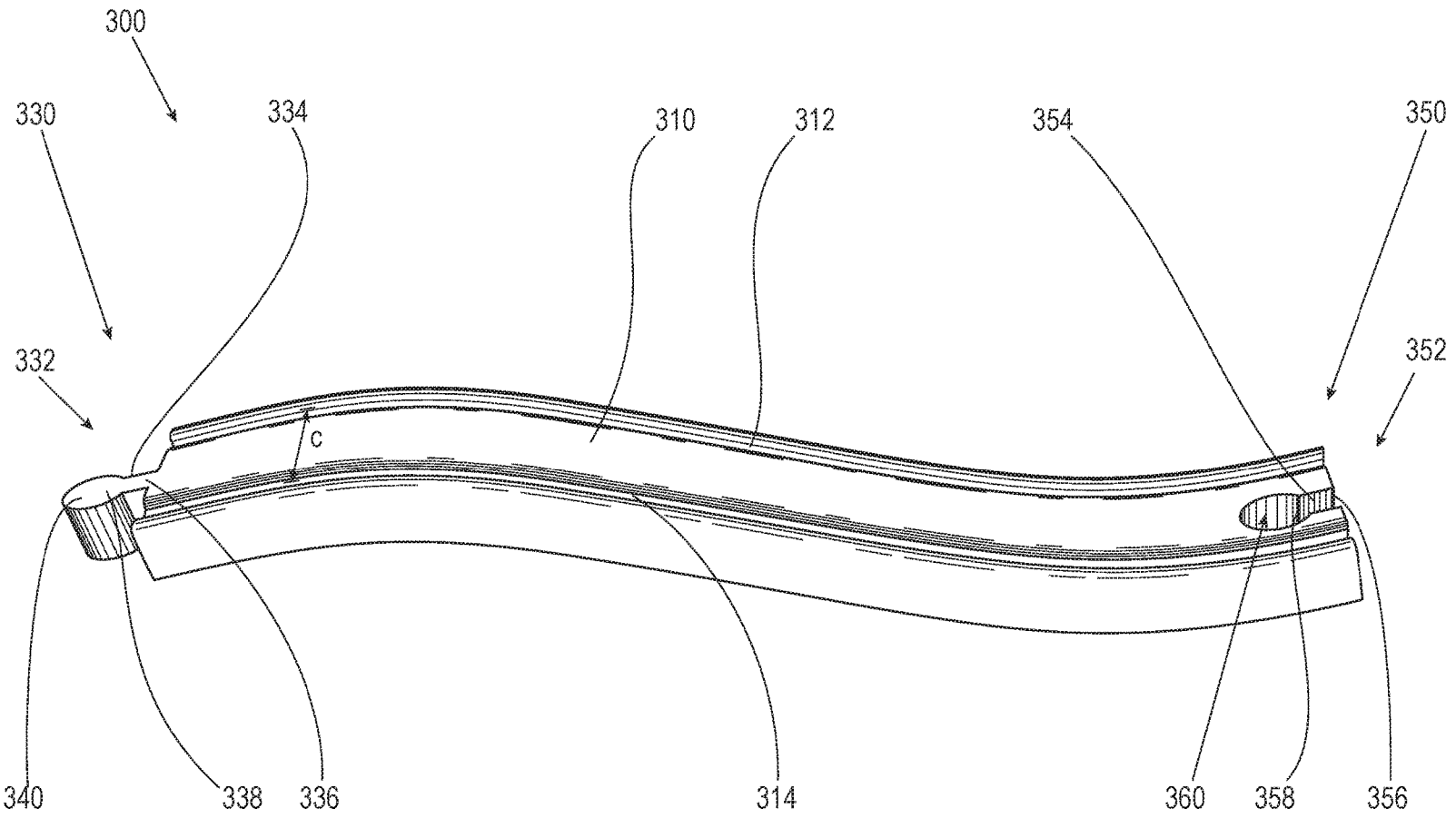
FIG. 9 illustrates a side view of an ascending track section configured to be coupled to the track risers illustrated in FIGS. 1 and 7.

Turning to FIG. 9, illustrated is an ascending track section 300 that is configured to be coupled to the track riser 10 or another track section 200, 300. The ascending track section 300 includes a top surface 310, a bottom surface 320 (not illustrated), a first end 330, and a second end 350. As illustrated in FIG. 9, the ascending track section 300 includes undulations that, when the ascending track section 300 is coupled to another track section 200, 300 or the track riser 10, positions the first end 330 and the second end 350 at different heights. For example, in the orientation of the track illustrated in FIG. 9, when the ascending track section 300 is coupled to other track sections 200, 300 and/or a track riser 10, the second end 350 will be disposed on a support surface while the first end 330 will be disposed above the support surface. Another ascending track section 300 with a different orientation may have the first end 330 disposed on the support surface and the second end 350 disposed above the support surface when that ascending track section 300 is coupled to other track sections 200, 300 and/or a track riser 10.

As illustrated in FIG. 9, the top surface 310 includes a first track depression 312 and a second track depression 314. The first and second track depressions 312, 314 of the ascending track section 300 are spaced from one another a distance C. The distance C is equivalent to the distance A, which is the length of the spacing between the first and second track depressions 112, 114 of the track riser 10, and distance B, which is the length of the spacing between the first and second track depressions 212, 214 of the flat track section 200. The first and second track depressions 312, 314 are disposed on the ascending track section 300 to extend from the first end 330 to the second end 350 of the ascending track section 300.

The ascending track section 300 includes a male connector 332 that is substantially similar to the male connector 170 of the track riser 10 and the male connector 232 of the flat track section 200. The ascending track section 300 also includes a female connector 352 that is substantially similar to the female connector 252 of the flat track section 200 and the female connector 180 of the track riser 10. As illustrated in FIG. 9, the male connector 332 of the ascending track section 300 extends from the first end 330 of the ascending track section 300. This male connector 332 also includes an extension portion 334 and a protrusion portion 340. The extension portion 334 includes a first end 336 and a second end 338, where the first end 336 of the extension portion 334 is coupled to the first end 330 of the ascending track section 300. Moreover, the protrusion portion 340 is coupled to the second end 338 of the extension portion 334. As illustrated in FIG. 9, the protrusion portion 340 is substantially cylindrical in shape, and is wider than the extension portion 334 of the male connector 332.

The female connector 352 of the ascending track section 300 includes a first opening portion 354 and a second opening portion 360. The first opening portion 354 includes a first end 356 and a second end 358, where the first end 356 is disposed proximate to the second end 350 of the ascending track section 300. The first opening portion 354 extends inwardly from the second end 350 of the ascending track section 300 toward the first end 330 of the ascending track section 300, creating an opening that extends between the top surface 310 and the bottom surface 320 of the ascending track section 300. Disposed on the second end 358 of the first opening portion 354 is the second opening portion 360. As illustrated in FIG. 9, the second opening portion 360 has a substantially circular cross section and extends between the top surface 310 and the bottom surface 320.

The male connector 232 of the flat track section 200 is configured to mate with the female connector 252 of another flat track section 200, the female connector 352 of an ascending track section 300, or the female connector 180 of the track riser 10. The male connector 332 of the ascending track section 300 is configured to mate with the female connector 352 of another ascending track section 300, the female connector 252 of a flat track section 200, or the female connector 180 of the track riser 10. It then follows that the female connector 252 of the flat track section 200 is configured to mate with the male connector 232 of another flat track section 200, the male connector 332 of an ascending track section 300, or the male connector 170 of the track riser 10. Similarly, the female connector 352 of the ascending track section 300 is configured to mate with the male connector 332 of another ascending track section 300, the male connector 232 of a flat track section 200, or the male connector 170 of the track riser 10.

In addition, the flat track section 200 and the ascending track section 300 may be constructed from wood, or a wood composite. In another embodiment, the track sections 200, 300 may be constructed from plastic, metal, or another suitable material. The track riser 10 illustrated in FIGS. 1-7 may be constructed from plastic. However, in another embodiment, the track riser 10 may also be constructed from wood, metal, or another suitably sturdy material.

Figure 10:
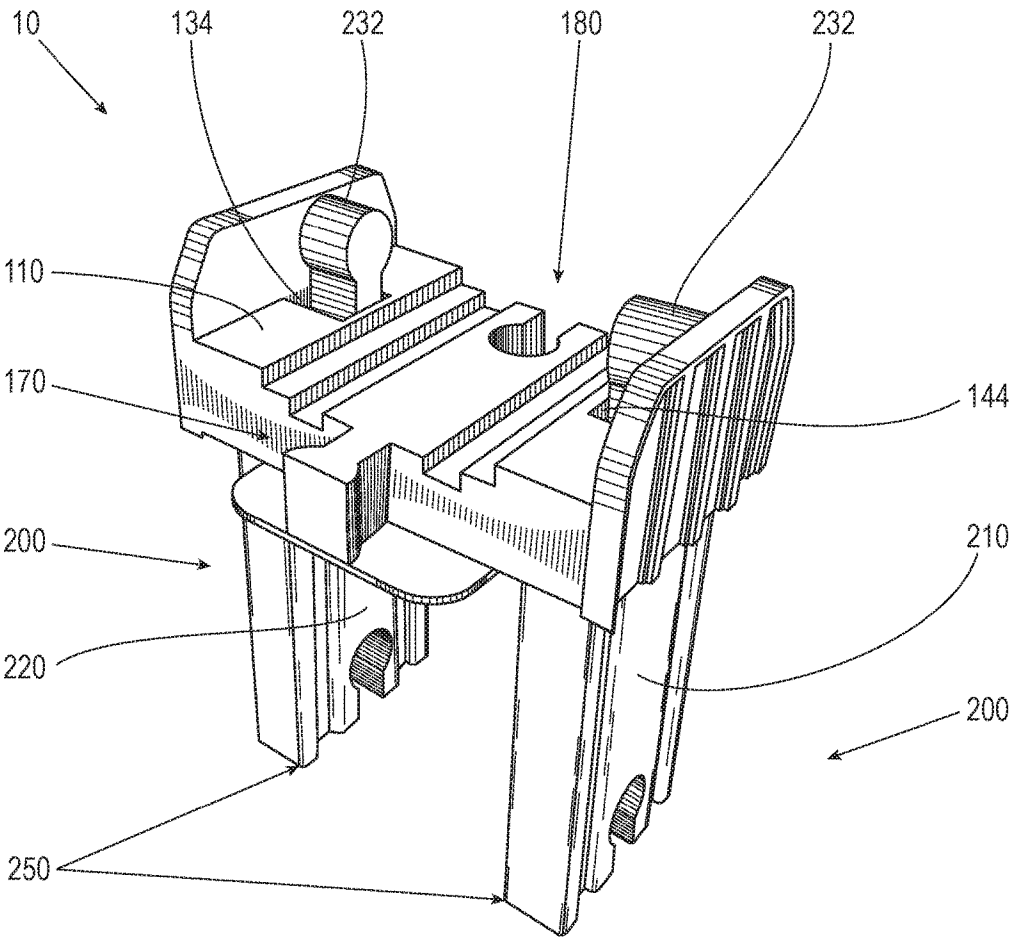
FIG. 10 illustrates a perspective view of the track riser illustrated in FIG. 1 with two of the flat track sections illustrated in FIG. 8 coupled to the track riser.

Turning to FIG. 10, illustrated is the track riser 10 in use with two flat track sections 200 coupled to the bottom 120 of the track riser 10. As illustrated, the two flat track sections 200 are of equal length. The flat track sections 200 are coupled to the track riser 10, where the flat track sections 200 are inserted through the bottom 120 of the track riser 10 so that at least a portion of the male connectors 232 of the flat track sections 200 are extending through the first and second openings 134, 144 of the track riser 10. As illustrated in FIG. 10, the protrusion portions 240 of the two flat track sections 200 are positioned above the top surface 110 of the track riser 10, while the extension portions 234 are positioned within the openings 134, 144 of the track riser 10. Thus, the flat track sections 200 are positioned to be substantially vertical, where the second ends 250 are disposed on the support surface and the first ends 230 are disposed adjacent the bottom 120 of the track riser 10. While not illustrated in FIG. 10, the first ends 230 of the two flat track sections 200 are inserted into the first and second slots 122, 124 on the bottom 120 of the track riser 10. Additionally, the flat track sections 200 may be coupled to the track riser 10 so that the bottom surfaces 220 of the flat track sections 200 are facing one another, while the top surfaces 210 are facing outwardly away from the track riser 10. In the positioning illustrated in FIG. 10, the flat track sections 200 serve as supports that elevate the track riser 10 above the support surface. As illustrated in FIG. 10, the track riser 10 is a track section disposed above a support surface. It follows that the longer in length the flat track sections 200 are that are coupled to the bottom 120 of the track riser 10, the farther the track riser 10 is disposed above the support surface. Moreover, if the flat track sections 200 are of unequal length, the flat track sections 200 will not be able to support the track riser 10 on a flat support surface.

Continuing with FIG. 10, because at least a portion of the male connectors 232 of the flat track sections 200 extend through the first and second openings 134, 144 of the track riser 10, female connectors 252 of a second set of flat track sections 200 may be coupled to these male connectors 232 to create a set of vertical flat track sections 200 that extend above the track riser 10. A second track riser 10 may then be placed on the second set of flat track sections 200 to create bi-level portions of track. A user may be able to continue to stack track risers 10 on top of one another to create multi-level portions of track. In some embodiments of the track riser 10, the male connectors 232 may not extend far enough through the first and second openings 134, 144 to enable the female connectors 252 of another flat track section 200 to be coupled to the male connectors 232. Thus, another embodiment of the track riser 10 may include a first recess 136 (not illustrated) disposed on the top surface 110 around the first opening 134, and a second recess 146 (not illustrated) disposed on the top surface 110 around the second opening 144. The first and second recesses 136, 146 may be sized and shaped to receive the second ends 250 of a second set of flat track sections 200 so that the female connectors 252 on the second ends 250 of the second set of flat track sections 200 may be coupled to the male connectors 232 of the flat track sections 200 that are extending through the first and second openings 134, 144.

As discussed previously, another embodiment of the track riser 10 may include a first receiver and a second receiver instead of first and second openings 134, 144. Similarly to the embodiment of the track riser 10 illustrated in FIG. 10, flat track sections 200 of substantially equal length are coupled to this other embodiment of the track riser 10, where the flat track sections 200 are inserted into the first and second receivers that are coupled to the bottom surface 120 of the track riser 10. The flat track sections 200 are positioned within the first and second receivers to be substantially vertical, where the second ends 250 are disposed on the support surface and the first ends 230 are disposed proximate to the bottom surface 120 of the track riser 10. This embodiment differs from the embodiment illustrated in FIG. 10 in that the male connectors 232 of the flat track sections 200 coupled to the track riser 10 are not extending through and positioned above the top surface 110 of the track riser 10.

Figure 11:
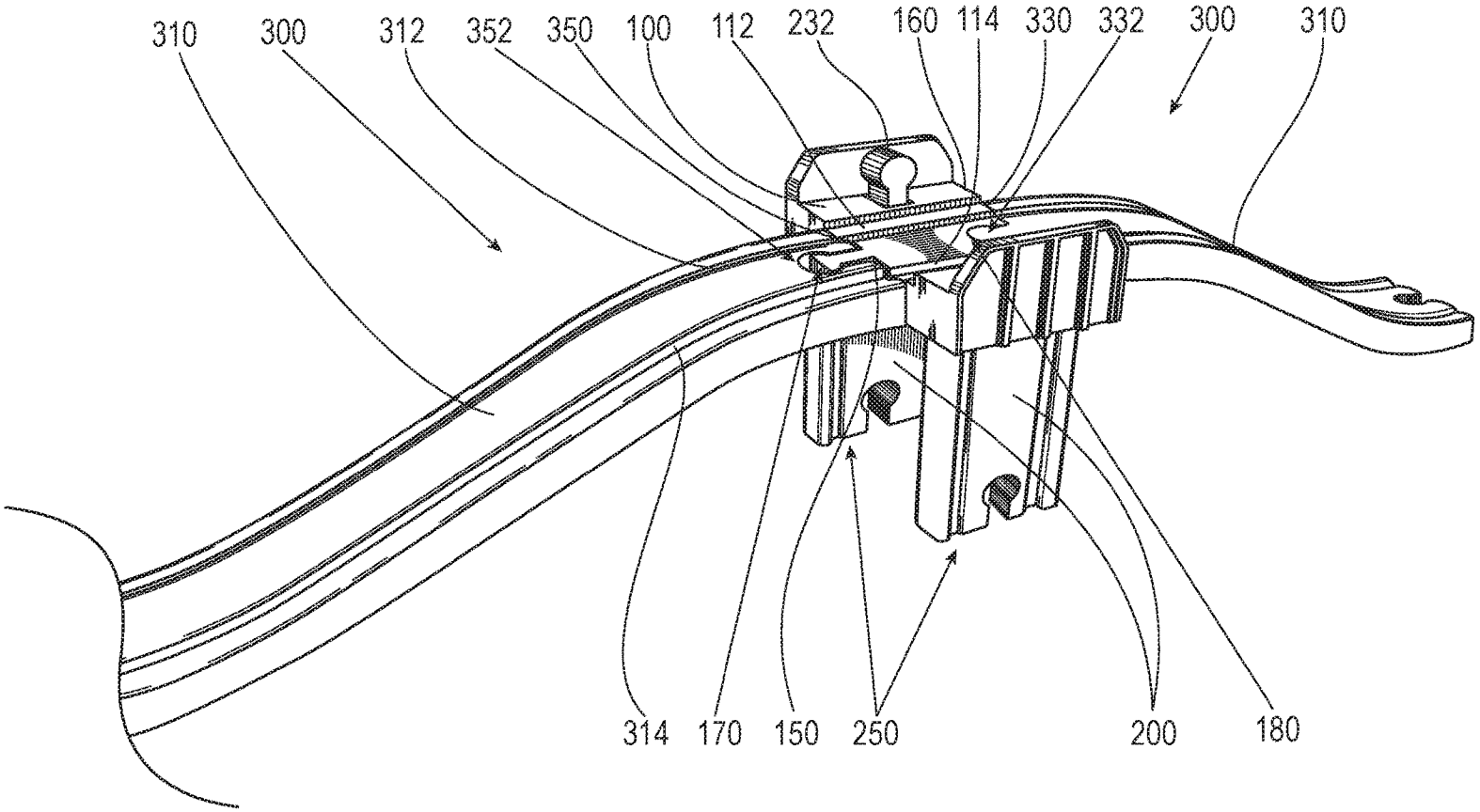
FIG. 11 illustrates a perspective view of the track riser and two flat track sections as illustrated in FIG. 10 with ascending track sections coupled to the front and rear ends of the track riser.
Figure 12:
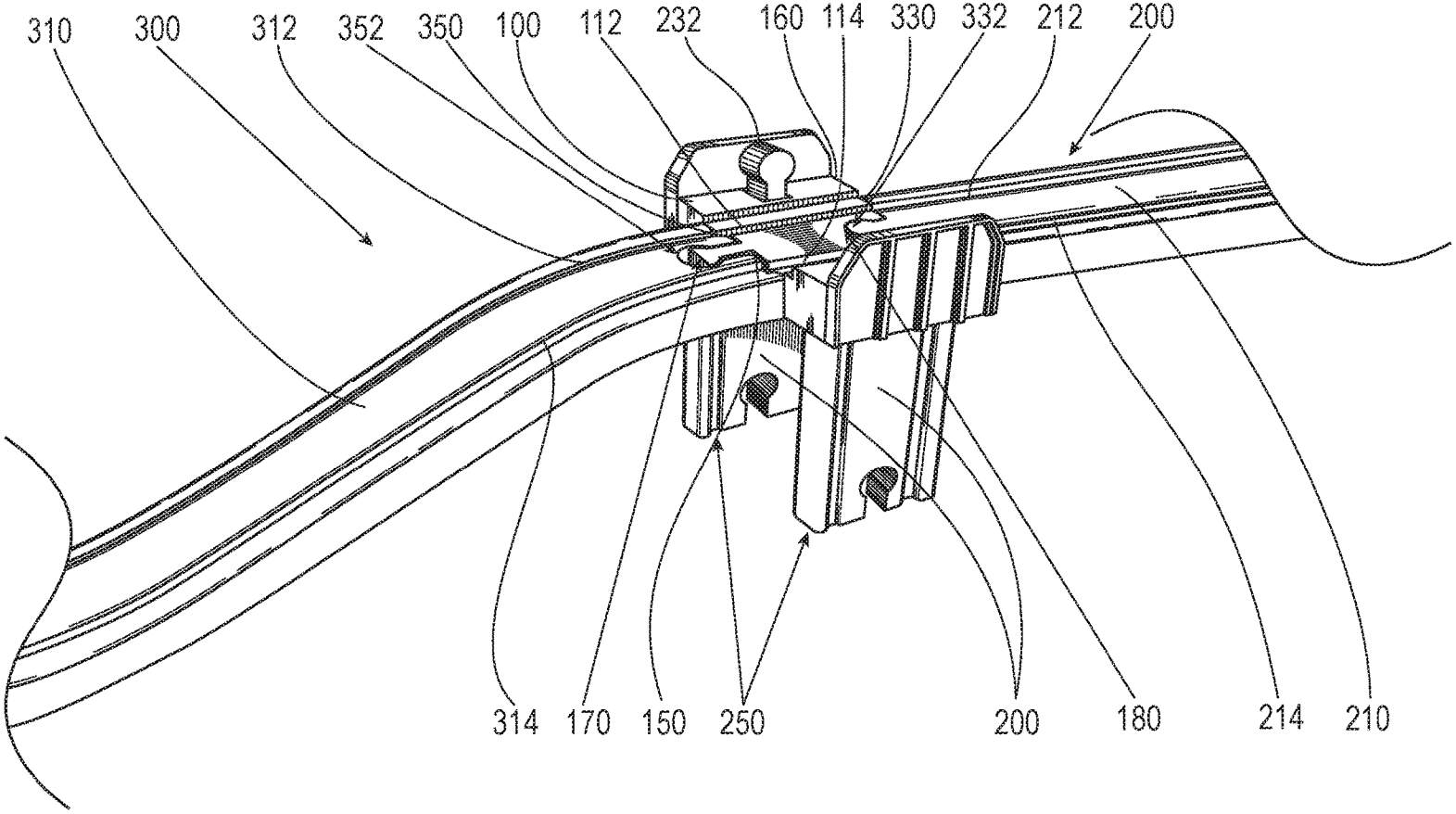
FIG. 12 illustrates a perspective view of the track riser and two flat track sections as illustrated in FIG. 10 with an ascending track section coupled to the front end of the track riser and a flat track section coupled to the rear end of the track riser.

Turning to FIGS. 11 and 12, illustrated is the track riser 10 in the position illustrated in FIG. 10, but with track sections 200, 300 coupled to the male and female connectors 170, 180 of the track riser 10. As illustrated in FIGS. 11 and 12, an ascending track section 300 is coupled to the front end 150 of the track riser 10. The second end 350, which contains the female connector 352, of the ascending track section 300 is coupled to the front end 150 of the track riser 10. The male connector 170 of the track riser 10 is positioned within the first and second openings 354, 360 of the female connector 352 of the ascending track section 300, which couples the ascending track section 300 to the track riser 10. Furthermore, when connected to the track riser 10, the first and second track depressions 312, 314 of the ascending track section 300 align with the first and second track depressions 112, 114 of the track riser 10. As explained previously, and as illustrated in FIGS. 11 and 12, the ascending track section 300, because of its shape, positions the second end 350 of the ascending track section 300 above the support surface. The male connector 170 of the track riser 10, as previously explained, includes a platform 179 positioned below the extension portion 172 and the protrusion portion 178. The platform 179 prevents female connector 352 on the second end 350 of the ascending track section 300 from sliding downward and out of engagement with the male connector 170 of the track riser 10 due to the force of gravity. When a toy vehicle (not shown) travels along the ascending track section 300 from the first end 330 to the second end 350 the toy vehicle (not shown) travels upward away from the support surface toward the track riser 10.

FIGS. 11 and 12 differ from one another in that a second ascending track section 300 is coupled to the rear end 160 of the track riser 10 in FIG. 11, and a flat track section 200 is coupled to the rear end 160 of the track riser 10 in FIG. 12. The differences in FIGS. 11 and 12 demonstrate the versatility of the track riser 10, and how it can be used with a variety of track sections 200, 300. As illustrated in FIG. 11, two ascending track sections 300 and the track riser 10 create a hill that toy vehicles (not shown) may travel over. As illustrated in FIG. 12, the track riser 10, by being coupled to a single ascending track section 300 and a single flat track section 200, creates an elongated segment of elevated track (the track riser 10 and the flat track section 200, along with any other track sections coupled to the flat track section 200). The second end 250 (not illustrated in FIG. 12) of the flat track section 200 may be connected to another track riser 10, an elevated support, or another elevated track section 200, 300.

As illustrated in FIG. 11, the first end 330 of the second ascending track section 300 is coupled to the rear end 160 of the track riser 10. The first end 330, which contains the male connector 332, of the ascending track section 300 is coupled to the female connector 180 of the track riser 10 by the male connector 332 of the ascending track section 300 being positioned within the female connector 180 of the track riser 10. Similar to the first ascending track section 300 previously explained, the first and second track depressions 312, 314 of this second ascending track section 300 align with the first and second track depressions 112, 114 of the track riser 10. Furthermore, because this second ascending track section 300 has a different orientation than the first ascending track section 300, the second ascending track section 300 positions the first end 330 of above the support surface when connected to the track riser 10. Moreover, the female connector 180 of the track riser 10, as previously explained, includes a platform 189 positioned below the second cavity portion 188, where the platform 189 prevents the male connector 332 on the first end 330 of the second ascending track section 300 from sliding downward and out of engagement with the female connector 180 of the track riser 10 due to the force of gravity.

Similarly to the second ascending track section 300 of FIG. 11, as illustrated in FIG. 12, the first end 230 of the flat track section 200 is coupled to the rear end 160 of the track riser 10. The male connector 232 of the first end 230 of the flat track section 200 is coupled to the female connector 180 of the track riser 10 by the male connector 232 of the flat track section 200 being positioned within the female connector 180 of the track riser 10. Furthermore, when connected to the track riser 10, the first and second track depressions 212, 214 of the flat track section 200 align with the first and second track depressions 112, 114 of the track riser 10. Because track riser 10 is positioned above the support surface, the female connector 180 of the track riser 10, as previously explained, includes a platform 189 positioned below the second cavity portion 188. The platform 189 prevents the male connector 232 on the first end 230 of the flat track section 200 from sliding downward and out of engagement with the female connector 180 of the track riser 10 due to the force of gravity.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Therefore, although the disclosed inventions are illustrated and described herein as embodied in one or more specific examples, it is nevertheless not intended to be limited to the details shown, since various modifications and structural changes may be made therein without departing from the scope of the inventions. Further, various features from one of the embodiments may be incorporated into another of the embodiments. Accordingly, it is appropriate that the invention be construed broadly and in a manner consistent with the scope of the disclosure.

What is claimed is:

1. A toy vehicle track section, comprising a body with a top surface, a bottom surface, a first side, a second side, a front side, and a rear side;

a first connector coupled to the front side of the body, the first connector configured to couple a first segment of toy vehicle track to the body via a track connector on the first segment of toy vehicle track;

a second connector coupled to the rear side of the body, the second connector configured to couple a second segment of toy vehicle track to the body via a track connector on the second segment of toy vehicle track;

a first receiver coupled to the bottom surface of the body, the first receiver being disposed on the body proximate to the first side; and a second receiver coupled to the bottom surface of the body, the second receiver being disposed on the body proximate to the second side, wherein the first receiver is configured to receive a track connector of a third segment of toy vehicle track and the second receiver is configured to receive a track connector of a fourth segment of toy vehicle track, wherein the track connector of at least one of the first and second segments of toy vehicle track is identical to the track connector of the third and fourth segments of toy vehicle track.

2. The toy vehicle track section of claim 1, wherein the first connector is a male connector extending from the front side of the body, and the second connector is a female connector formed as a cavity within the body proximate to the rear side of the body.

3. The toy vehicle track section of claim 1, wherein the first receiver and the second receiver extend inwardly from the bottom surface of the body.

4. The toy vehicle track section of claim 1, further comprising a pair of track depressions disposed within the top surface of the body, the pair of track depressions spanning along the top surface of the body from the front side to the rear side of the body.

5. The toy vehicle track section of claim 1, further comprising a first opening disposed in the body and aligned with the first receiver, wherein when the first receiver receives the track connector of the third segment of toy vehicle track, the track connector of the third segment of toy vehicle track at least partially extends through the first opening.

6. The toy vehicle track section track of claim 5, further comprising a second opening disposed in the body and aligned with the second receiver, wherein when the second receiver receives the track connector of the fourth segment of toy vehicle track, the track connector of the fourth segment of toy vehicle at least partially extends through the second opening.

7. A toy vehicle track riser, comprising a body with a top surface, a bottom surface, a first side, and a second side;

a first connector disposed on the first side of the body, the first connector configured to couple with a track connector of a first segment of toy vehicle track;

a second connector disposed on the second side of the body, the second connector configured to couple with a track connector of a second segment of toy vehicle track;

a first receiver disposed in the bottom surface of the body; and a second receiver disposed in the bottom surface of the body, wherein the first receiver is configured to receive a first end of a third segment of toy vehicle track and the second receiver is configured to receive a first end of a fourth segment of toy vehicle track, the third and fourth segments of toy vehicle track supporting the body above a support surface;

wherein the track connector of at least one of the first and second segments of toy vehicle track is identical to the first ends of the third and fourth segments of toy vehicle track.

8. The toy vehicle track riser of claim 7, wherein the first connector is a male connector extending from the first side of the body, and the second connector is a female connector formed as a cavity within the body proximate to the second side of the body.

9. The toy vehicle track riser of claim 7, wherein the first receiver and the second receiver extend inwardly from the bottom surface of the body.

10. The toy vehicle track riser of claim 7, further comprising a pair of track depressions disposed within the top surface of the body, the pair of track depressions spanning along the top surface of the body from the first side to the second side of the body and forming a segment of toy vehicle track.

11. The toy vehicle track riser of claim 10, wherein the first segment of toy vehicle track and the second segment of toy vehicle track each include a pair of track depressions, and the pair of track depressions disposed on the top surface of the body are aligned with the pair of track depressions of the first and second segments of toy vehicle track when the first and second segments of toy vehicle track are coupled to the body.

12. The toy vehicle track riser of claim 7, wherein the first and second receivers are also configured to alternatively receive a track connector of at least one of the first segment of toy vehicle track and the second segment of toy vehicle track.

13. The toy vehicle track riser of claim 7, further comprising a first opening disposed in the body and aligned with the first receiver, wherein when the first receiver receives the first end of the third segment of toy vehicle track, a first connector on the first end of the third segment of toy vehicle track at least partially extends through the first opening.

14. The toy vehicle track riser of claim 13, further comprising a second opening disposed in the body and aligned with the second receiver, wherein when the second receiver receives the first end of the fourth segment of toy vehicle track, a first connector on the first end of the fourth segment of toy vehicle track at least partially extends through the second opening.

15. A toy vehicle track riser, comprising a body with a top surface, a bottom surface, a first side, and a second side;

a first connector disposed on the first side of the body, the first connector configured to couple with a track connector of a first segment of toy vehicle track;

a second connector disposed on the second side of the body, the second connector configured to couple with a track connector of a second segment of toy vehicle track;

a first receiver disposed in the bottom surface of the body;

a second receiver disposed in the bottom surface of the body, wherein the first receiver is configured to receive a first end of a third segment of toy vehicle track and the second receiver is configured to receive a first end of a fourth segment of toy vehicle track, the third and fourth segments of toy vehicle track supporting the body above a support surface;

a first opening disposed in the body and aligned with the first receiver, wherein when the first receiver receives the first end of the third segment of toy vehicle track, a first connector on the first end of the third segment of toy vehicle track at least partially extends through the first opening;

a second opening disposed in the body and aligned with the second receiver, wherein when the second receiver receives the first end of the fourth segment of toy vehicle track, a first connector on the first end of the fourth segment of toy vehicle track at least partially extends through the second opening;

wherein:

the first connector of the third segment of toy vehicle track extends completely through the first opening and beyond the top surface of the body and is configured to be coupled to a second connector of a fifth segment of toy vehicle track;

the first connector of the fourth segment of toy vehicle track extends completely through the second opening and beyond the top surface of the body and is configured to be coupled to a second connector of a sixth segment of toy vehicle track;

and the fifth and sixth segments of toy vehicle track extend vertically from the top surface of the body.

16. The toy vehicle track riser of claim 15, wherein a first connector of the fifth segment of toy vehicle track and a first connector of the sixth segment of toy vehicle track are configured to be received by a second toy vehicle track riser to position the second toy vehicle track riser vertically above the top surface of a body of the toy vehicle track riser.

* * * * *